United States Patent [19]

Rudolf et al.

[11] Patent Number: 4,779,382

[45] Date of Patent: Oct. 25, 1988

[54] MECHANISM FOR MOUNTING A DISK-SHAPED ATTACHMENT ON THE SPINDLE OF A PORTABLE ELECTRIC TOOL

[75] Inventors: Boris Rudolf, Stuttgart; Josef Gentischer, Weinstadt; Horst Litsche, Wildberg, all of Fed. Rep. of Germany

[73] Assignee: C. & E. Fein GmbH & Co., Stuttgart, Fed. Rep. of Germany

[21] Appl. No.: 72,171

[22] Filed: Jul. 10, 1987

[30] Foreign Application Priority Data

Jul. 12, 1986 [DE] Fed. Rep. of Germany ..... 3623555

[51] Int. Cl.[4] ..... B24B 23/02

[52] U.S. Cl. ..... 51/168; 83/666

[58] Field of Search ..... 51/168, 170 R, 170 PT, 51/170 T; 83/666, 698; 279/1 K, 8

[56] References Cited

U.S. PATENT DOCUMENTS 3,691,900 9/1972 Novak et al. ..... 51/168

4,597,227 1/1986 Gentischor et al. .

*Primary Examiner*—Roscoe V. Parker

*Attorney, Agent, or Firm*—Max Fogiel

[57] ABSTRACT

A mechanism for mounting a sanding disk to the spindle of a portable right-angled grinder that will allow the connection to be released without extra tools. The mechanism consists essentially of a hollow spindle (18), of a tensioning anchor (22) that is accommodated inside the spindle (18) such that it can slide back and forth axially subject to an activating mechanism (54) but cannot rotate, and of two flanges that accommodate the sanding disk (28) between them, one of which, a mating flange that constitutes a support (20), is rigidly secured to the spindle, and the other of which, the tensioning flange (26), is loosely secured to the tensioning anchor (22). Between mutually facing demarcating surfaces (34 & 36) of the tensioning anchor (22) and the spindle (18) is a space (39) that communicates with another space (44) in the tensioning anchor (22). The spaces (39 & 44) are full of a plastic material (40) that can transmit force hydraulically. A piston (46) is accommodated in the second space (44), slides back and forth subject to the activating mechanism (54), forcing the plastic material out and creating tensioning force in the space (39), and can be secured in the tensioning position.

28 Claims, 5 Drawing Sheets

Figure 1:
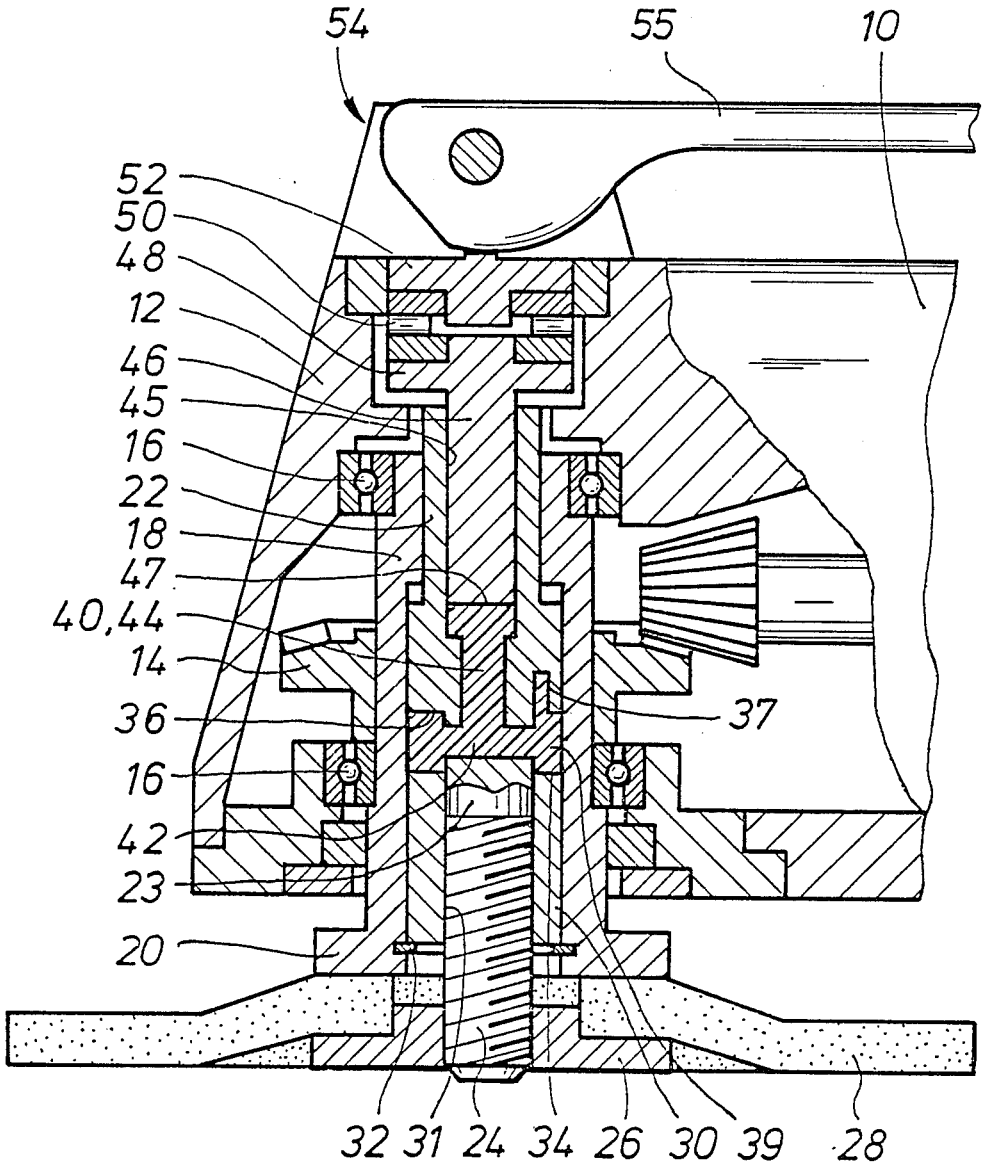

MECHANISM FOR MOUNTING A DISK-SHAPED ATTACHMENT ON THE SPINDLE OF A PORTABLE ELECTRIC TOOL

The invention concerns a mechanism for mounting a disk-shaped attachment on the motor-driven spindle of a portable electric tool. The mechanism is especially appropriate for mounting a sanding disk on the spindle of a portable right-angled grinder. Circular-saw blades, cutting disks, and other attachments can, however, also be similarly mounted. A mechanism on a right-angled grinder of this type is known (from German Pat. No. 3 405 885). It can be employed to manually mount and unmount sanding disks in conjunction with an activating mechanism integrated into the tool without additional tools. It includes for that purpose a pivoting lever that acts on an axially displaceable tensioning anchor inside the spindle, which is a hollow sleeve. The tensioning anchor can be displaced against the force of a compression spring until a flange-like tensioning net screwed onto its free end lifts off the sanding disk and can accordingly be easily removed by hand. The tensioning anchor is non-rotationally secured to the spindle by means of teeth. Since the compression spring has to overcome the major component of the tension exerted on the sanding disk, certain minimum dimensions are necessary to allow the known mechanism to be employed with large right-angled grinders specifically and with two-hand operation right-angled grinders in particular.

The object of the invention is to thoroughly improve the known mechanism for mounting disk-shaped attachments of the aforesaid type to the extent that it will be small enough to employ with smaller portable electric tools as well, especially with one-hand operation grinders.

The point of departure for the invention is the concept that the securing tension between the tensioning flange, the attachment, and the mating flange and hence between the spindle and the tensioning anchor, should be fairly powerful while the attachment is in the mounted state, whereas the tensioning flange should be relieved of tension while the attachment is being unmounted so that it can be unscrewed from the tensioning anchor. These conditions are attained in accordance with the invention in that the tensioning anchor and the spindle in conjunction demarcate a space that defines a variable axial interval between facing demarcating surfaces of the components, that communicates with another space n the tensioning anchor or in the spindle, and in that the spaces are full of a cohesive plastic material that transmits pressure hydraulically. The second space also accommodates a piston that is displaced when the volume of the space is altered and that can be secured in a tensioning position.

The first space in one preferred embodiment of the invention, wherein the spindle is a sleeve and the tensioning anchor slides back and forth axially inside i, is demarcated by a surface of the sleeve that faces one side of the activating mechanism and by another and opposing surface on the tensioning anchor that faces the attachment, whereas the tensioning anchor has an axial bore that opens toward one side of the activating mechanism and extends as far as the second space to accommodate the piston. The spaces also communicate through essentially radial bores in the tensioning anchor.

The surface of the spindle that demarcates the spaces can consist of the inner face of a cylindrical bushing that is firmly inserted into the sleeve from the attachment end, with an axial bore that the tensioning anchor extends through, with a threaded pin on the end that the tensioning-flange nut is mounted on, whereas the tensioning anchor can have a space-demarcating surface in the form of a shoulder that opposes the inner face of the bushing.

To allow the piston to rotate around the axis of the spindle while the tool is being operated and still be able to slide axially to replace the attachment, the activating mechanism has a component that can slide axially in the drive-mechanism housing and that rests on a rotating bearing, which is preferably a needle bearing and which accommodates axial forces, against one axial bearing surface of the piston.

The activating mechanism in another practical embodiment of the invention has a threaded spindle that fits into a threaded bore in the tensioning anchor and that has a face that opposes the second space and that rests, either directly or indirectly through a loose piston, against the surface of the plastic material. The thread on the threaded spindle and on the threaded bore is in a practical way self-locking. The end of the threaded spindle that faces the attachment extends, in conjunction if need be with the tensioning anchor, through an opening in the drive-mechanism housing, and the threaded spindle can have a preferably knurled activating knob outside the drive-mechanism housing. The threaded spindle with the activating knob has a twofold function. The piston can be displaced axially into the second space by rotating the spindle, varying the tension accordingly. During the tension process, plastic material is thereby forced out of the second space into the first space, drawing the tensioning flange over the tensioning anchor and tensioning the disk-shaped attachment between them and against the support on the spindle. In the opposite procedure, once the spindle has been rotated out into the untensioned state, the tensioning anchor can be displaced toward the spindle by applying axial force against the head of the spindle until the tensioning flange loosens due to the increasing distance away from the support and can accordingly be easily removed from the tensioning anchor. Plastic material will simultaneously flow out of the first space, which will become smaller during the displacement, into the second space, which contains the piston.

The end of the threaded spindle that is accessible from outside can for safety's sake be protected from unintentional activation by a cover that is hinged to the drive-mechanism housing. The cover has a locking mechanism, preferably in the form of a catch that is active or can be snapped in only when the activating mechanism has been tensioned. A safety switch that can be triggered by the cover or the cover-locking mechanism can also be provided to ensure that the machine can be turned on only when the cover is closed. To ensure automatic untensioning of the tensioning mechanism while the activating mechanism is being opened, a compression spring that acts against the tensioning force can be accommodated in accordance with the invention in a space between the spindle and the tensioning anchor. The compression spring can be a helical spring or a set of cup springs. The compression spring is designed such that its force will be more powerful than the resistance to displacement between the spindle and the tensioning anchor, including the deformation resistance and flow resistance that must be overcome in the vicinity of the plastic material during displacement.

To ensure that the loose piston will be displaced only axially in the second space and will not rotate along with the activating spindle, toothed grooves can be provided in the wall of the piston and in the wall of its associated space to accommodate some of the plastic material.

In the embodiments described heretofore, there has been no detailed explanation on which plastic material is best adapted for the present invention. Basically, a number of plastic materials that are available could be used here, as long as these remain in plastic state. The most advantageous material, however, has been found to be the plastic material polyvinylchloride (PVC) which has a relatively low degree of polymerization, since this plastic material meets widely the requirements of portable electric tools. In a further advantageous embodiments it has been found desirable that when the bordering or limiting surface arranged at the tensioning anchor, i.e. the part of the bordering surface which is directed toward the tool side, is related to the cross-sectional surface of the piston by at least the ratio 50:1. Such a ratio permits in the present invention, a sufficiently large tensioning force for tensioning the tool at yet substantially large actuating force. It is even more advantageous when the ratio is 100:1, or is even 200:1 in the case of large portable hand tools.

Figure 2:
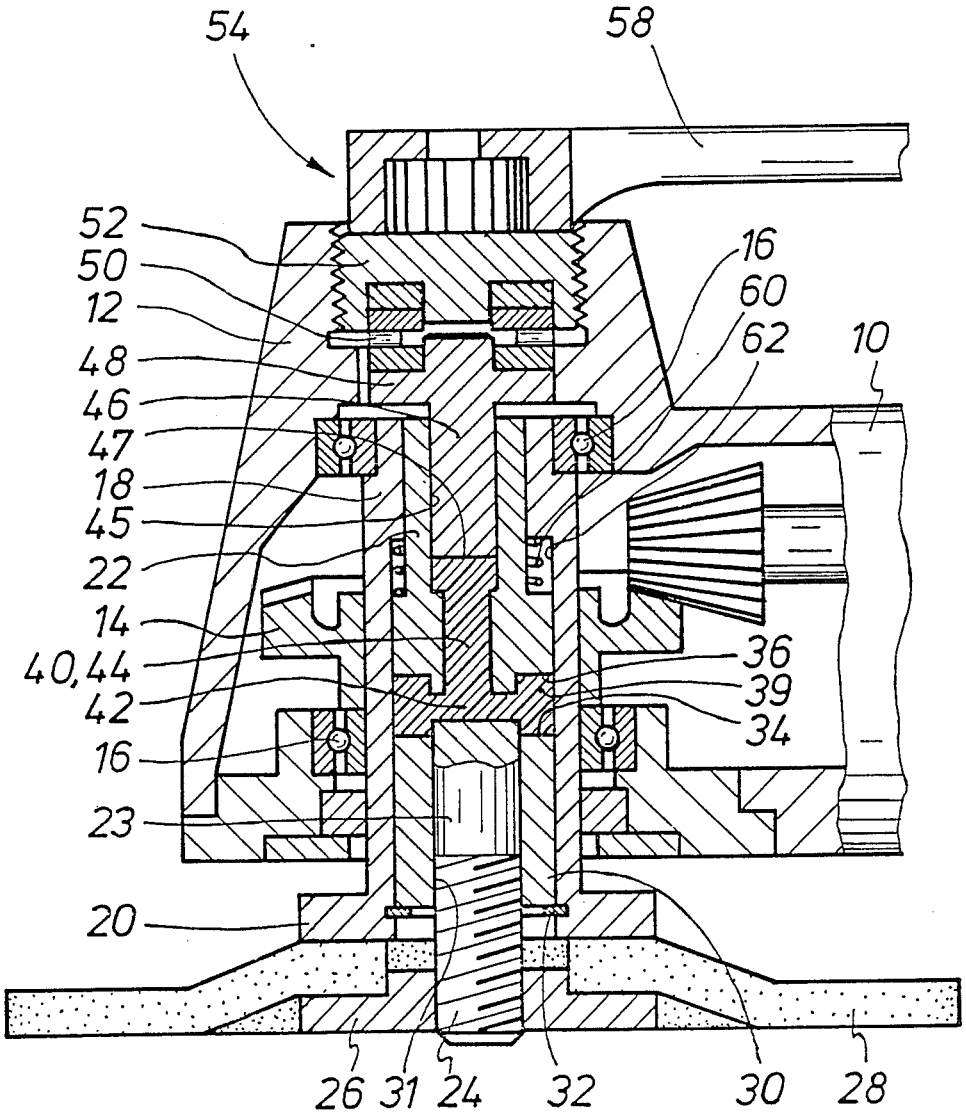
Figure 3:
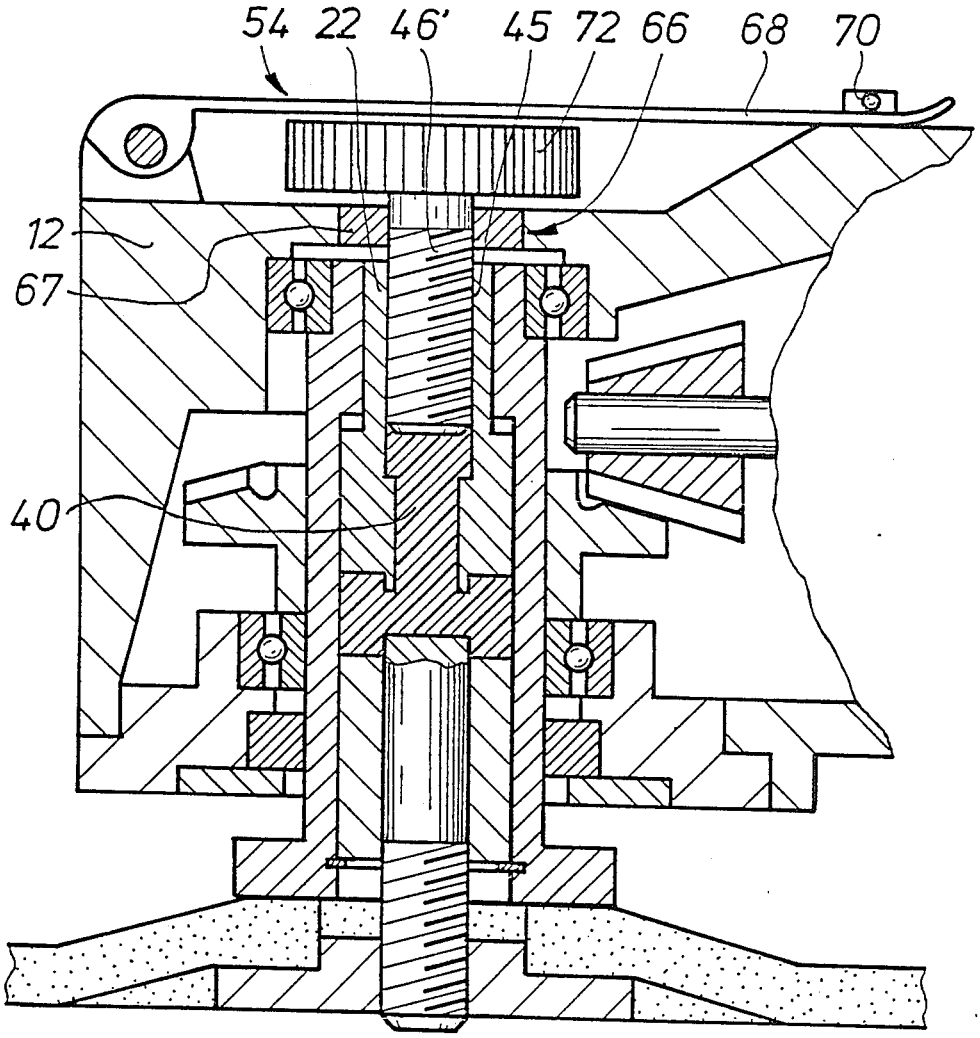
Figure 4:
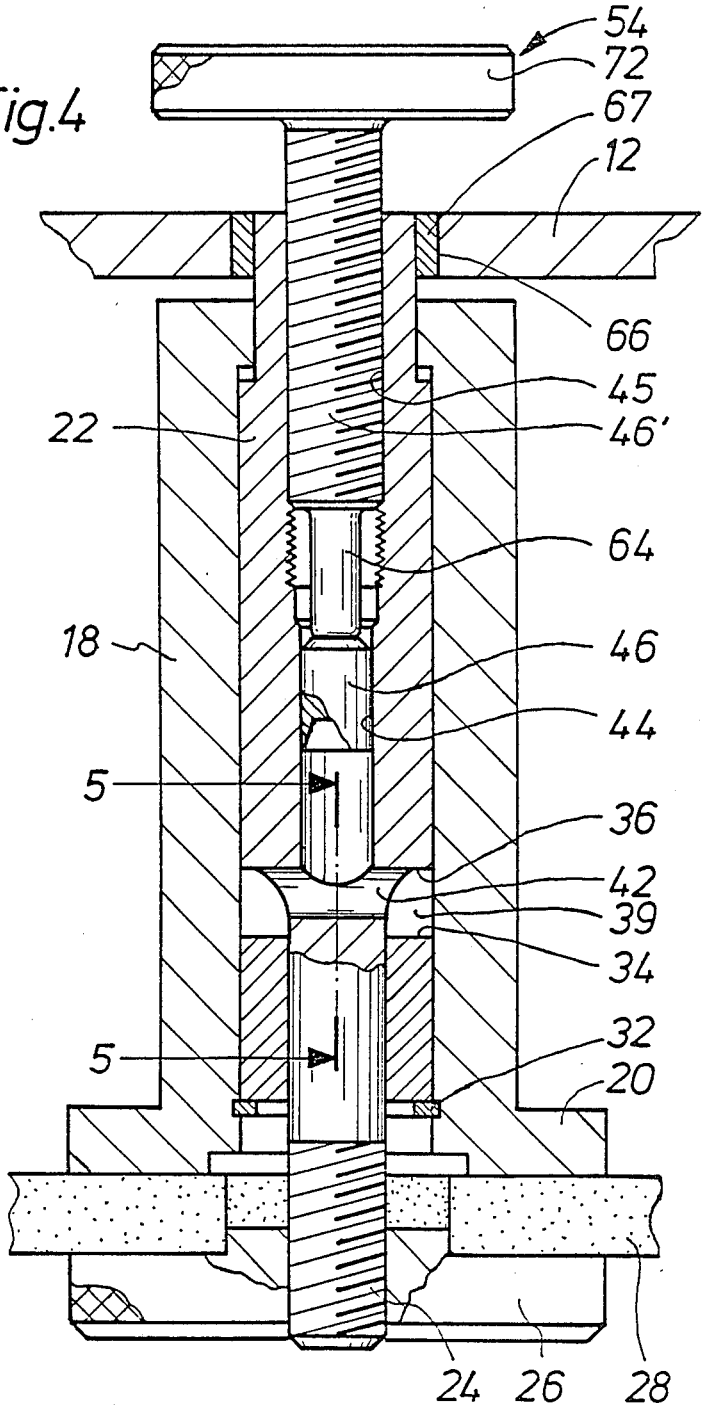
Figure 5:
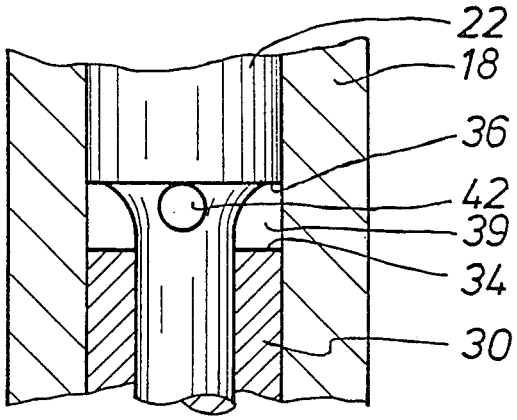

The invention will now be specified with reference to embodiments schematically illustrated in the drawing, wherein FIG. 1 is a vertical section through the drive-mechanism housing of a right-angled grinder with an eccentric lever to activate the tensioning mechanism, FIG. 2 is a vertical section through a right-angled grinder with a rotating lever to activate the tensioning mechanism, FIG. 3 is a vertical section through a right-angled grinder with a threaded spindle and a knurled activating knob to activate the tensioning mechanism, FIG. 4 is a vertical section through a right-angled frinder with a threaded spindle and a loose piston to activate the tensioning mechanism, and FIG. 5 is a section along the line 5—5 in FIG. 4.

A right-angled grinder consists essentially of an electric motor accommodated in a motor housing 10 that merges into a drive-mechanism housing 12 that accommodates a mitre gear 14. Mitre gear 14 drives a tool spindle 18 and a sanding disk 28 that can be mounted on the spindle by means of a tensioning mechanism. Spindle 18, which is a sleeve, is mounted in two radial roller bearings 16 in drive-mechanism housing 12. The end of spindle 18 that extends out of drive-mechanism housing 12 has a support 20, which a sanding disk 28 can be forced against by means of a tensioning flange 26. Tensioning flange 26 is in the form of a threaded nut that can be screwed onto the threaded pin 24 of a tensioning anchor 22 accommodated such that it can slide back and forth axially but not rotate inside sleeve 18. The butt end 23 of tensioning anchor 22 extends through an axial bore 31 in a bushing 30 that is inserted into sleeve 18 from below and secured with a retaining ring 32. Threaded pin 24 projects beyond the end of sleeve 18 that is in the vicinity of the flange. The inner face 34 of bushing 30, the adjacent axial inner surface of sleeve 18, and the shoulder 36 in tensioning anchor 22 that faces bushing 30 demarcate an annular space 39 that communicates through radial bores 42 in tensioning anchor 22 with another space 44. A piston 46 engages the axial bore 45 that leads to second space 44. The face 47 of piston 46 demarcates space 44. The volume of space 44 can be varied to a certain extent by displacing piston 46 in axial bore 45 by means of an activating mechanism 54.

Spaces 39 and 44 are full of a plastically deformable, essentially incompressible material 40 that coheres through bore 42. This material is for example polyvinyl chloride of a rather low polymerization degree that is inserted in a liquid form at a high temperature and has a gelatinous consistency at room temperature. Other chambers 37 that open into space 39 and can accommodate plastic material 40 can be provided in the walls 34 and 36 of the space. When piston 46 slides back and forth in bore 45, some of material 40 is forced into either space 39 or space 44, depending on the direction that the piston is sliding in, and changes the displacement position of tensioning anchor 22.

Piston 46 is farthest into space 44 when activating mechanism 54 is in the tensioned state. Since piston 46 is then secured in its inserted position by the activating mechanism, the connection between piston 46, tensioning anchor 22, plastic material 40, and sleeve 18 will be extremely rigid, with sanding disk 28 securely clamped between tensioning flange 26 and support 20. Piston 46 rotates along with these other components around the axis of the spindle as the powered spindle rotates. To allow this rotation there is an axial pivot bearing 50, preferably in the form of a needle bearing, between a pressure-application component 52 and a bearing plate 48 (FIGS. 1 & 2).

If, now, in order to remove the sanding disk, activating mechanism 54 is activated by lifting eccentric lever 55 (FIG. 1) or by rotating rotating lever 58 (FIG. 2), pressure-application component 52 will be lifted off the bearing plate 48 of piston 46. Since piston 46 can now slide to the extent of the play accordingly made available, plastic material 40 can be forced out of space 39 into space 44 by the application of force against tensioning anchor 22, and the tensioning anchor can be forced down an equal distance in relation to sleeve 18. This force can be exerted for example by an axially acting compression spring 60 in the form of a set of cup springs that can be accommodated in an annular space 62 between sleeve 18 and tensioning anchor 22 (FIG. 2) and that has a force that is more powerful than the resistance to the mutual displacement of these two components, including resistance to deformation and flow resistance, in the vicinity of plastic material 40. This displacement lifts tensioning flange 26 off of sanding disk 28. Since the total compression force between tensioning flange 26 and sanding disk 28 no longer needs to be overcome in order to loosen tensioning flange 26, which is in the form of a nut, tensioning flange or nut 26, which is preferably knurled, can easily be unscrewed from threaded pin 24 by hand, and sanding disk 28 can be unmounted.

In the reverse procedure employed to mount the sanding disk, disk 28 is inserted over threaded pin 24 and then forced against support 20 by means of tensioning flange or nut 26, which is screwed onto the pin by hand. During the subsequent tensioning operation carried out by means of activating mechanism 54, piston 46 is inserted into axial bore 45 until plastic material 40 is forced out of space 44 into space 39. Tensioning anchor 22 is accordingly retracted into sleeve 18 as the distance between the demarcating surfaces 34 and 36 on the side of threaded pin 24 increases, and tensioning flange 26 is forced against support 20 with sanding disk 28 clamped between them. The direction that spindle 18 rotates in and the pitch of threaded pin 24 are selected to ensure that tensioning flange or nut 26 will tighten automatically as the motor starts.

The activating mechanism in the embodiments illustrated in FIGS. 3 through 5 is a threaded spindle 46' that screws into a threaded bore 45 in tensioning anchor 22. In the embodiment illustrated in FIG. 3, threaded spindle 46' extends through an opening 66 provided with a seal 67 in drive-mechanism housing 12, whereas in the embodiment illustrated in FIG. 4 tensioning anchor 22 extends out through housing opening 66 along with threaded spindle 46'. At its activating end the threaded spindle has a knurled activating knob 72 that is overlapped by a cover 68 hinged to drive-mechanism housing 12 when activating mechanism 54 is in the tensioned state. Cover 68 can as a safety measure only be secured by means of a component 70 when activating spindle 46' is in the tensioned state. Cover-securing component 70 can if necessary have an unillustrated safety switch that will interrupt the supply of current to the motor when the cover is open.

The face of the activating spindle 46' in the embodiment illustrated in FIG. 3 itself constitutes the piston 46 that presses against plastic material 40, whereas in the embodiment illustrated in FIG. 4 a lose piston 46 is accommodated in second space 44 and is subject to a pin 64 shaped onto the face of spindle 46'.

We claim:

1. Mechanism for mounting a disk-shaped attachment on a motor-driven spindle that is accommodated in the drive-mechanism housing of a portable electric tool, especially for mounting a sanding disk on a right-angled grinder, with a tensioning anchor that slides back and forth but cannot rotate inside the spindle, which is in the form of a sleeve, and that extends beyond the attachment end of the spindle, with a tensioning flange that is secured to and can be released from the free end of the tensioning anchor, with a support that is located at the attachment end of the spindle, and with an activating mechanism for forcing the tensioning flange against the support with the attachment clamped between them and for releasing them, characterized in that the tensioning anchor (22) and the spindle (18) each have a demarcating surface (34 & 36) that face each other axially separated inside the spindle (18) in the form of a sleeve and jointly define a space (39) that communicates with another space (44) in the tensioning anchor (22) or in the spindle (18), in that a piston (46) that slides back and forth when the volume of the space is varied by the activating mechanism and that can be secured in at least one position is accommodated in the second space (44), and in that the spaces (39 & 44) are full of a plastic material (0) that can transmit force hydraulically.

2. Mechanism as in claim 1, characterized in that the activating mechanism (54) is positioned on the side of the drive-mechanism housing (12) that faces the attachment (28), in that the demarcating surface (34) associated with the sleeve (18) faces the side of the activating mechanism (54) and the opposite demarcating surface (36), which is associated with the tensioning anchor (22), faces the attachment side, and in that the tensioning anchor (22) has an axial bore (45) that opens toward the side of the activating mechanism (54) and extends into the second space (44) for accommodating a rod or spindle (46') that activates the piston (46).

3. Mechanism as in claim 2, characterized in that the second space (44), which is an extension of the axial bore (45), communicates through radial bores (42) with the first space (39), which is demarcated by the surfaces (34 & 36) of the spindle (18) and of the tensioning anchor (22).

4. Mechanism as in claim 2, characterized in that the space-demarcating surface (34) of the spindle (18) is constituted by the inner face of a cylindrical bushing (30) that is inserted into the sleeve (18) from the attachment end, in that the tensioning flange (26) is mounted on the butt end (23) of the tensioning anchor (22) and the butt end extends through the bushing's axial bore (31), and in that the tensioning anchor (22) has a space-demarcating surface in the form of a shoulder (36) opposing the inner face (34) of the bushing.

5. Mechanism as in claim 4, characterized in that chambers (37) that open into the space (39) are provided in the space-demarcating walls (24 & 36) to accommodate the plastic material (40).

6. Mechanism as in claim 1, characterized in that the activating mechanism (54) has a pressure-application component (52) that slides back and forth in the drive-mechanism housing (12) and that rests on a pivot bearing (50) that accepts axial forces against an axial bearing surface (48) of the piston (46).

7. Mechanism as in claim 6, characterized in that the pivot bearing (50) is an axial needle bearing.

8. Mechanism as in claim 1, characterized in that the activating mechanism (54) has an eccentric lever (55) that acts on the pressure-application component (52), which is accommodated in the drive-mechanism housing (12) but cannot rotate therein.

9. Mechanism as in claim 1, characterized in that the activating mechanism (54) has a rotating lever (58) that is connected to the pressure-application component (52), which is screwed into a thread (56) in the drive-mechanism housing (12).

10. Mechanism as in claim 1, characterized in that the activating mechanism (54) has a threaded spindle (46') that is screwed into a threaded bore (45) in the tensioning anchor (22).

11. Mechanism as in claim 10, caracterized in that the threaded spindle (46') is a piston (46).

12. Mechanism as in claim 10, characterized in that the threaded spindle (46') rests with its face or with a pin (64) shaped onto its face against the piston (46), which is loosely accommodated in the the second space (44).

13. Mechanism as in claim 10, characterized in that the threaded spindle (46') can be rotated self-locking in the threaded bore (45).

14. Mechanism as in claim 10, characterized in that the threaded spindle (46') extends through an opening (66) in the drive-mechanism housing (12).

15. Mechanism as in claim 10, characterized in that the threaded spindle (46') extends along with the tensioning anchor (22) through an opening (66) in the drive-mechanism housing (12).

16. Mechanism as in claim 14, characterized in that the threaded spindle (46') is accommodated in the vicinity of the opening (66) in the housing in a pivot bearing (50) that acts as a seal.

17. Mechanism as in claim 15, characterized in that the tensioning anchor (22) is accommodated in the vicinity of the opening (66) in the housing in a pivot bearing (67) that acts as a seal.

18. Mechanism as in claims 10, characterized in that the threaded spindle (46') has a preferably knurled activating knob (72) at its activating end.

19. Mechanism as in claim 10, characterized in that the threaded spindle (46') has a polygonal opening or polygonal head for a screwdriver or wrench at its activating end.

20. Mechanism as in claims 10, characterized in that the activating end of the threaded spindle (46') can be covered up by a cover (68) that is preferably hinged to the drive-mechanism housing (12).

21. Mechanism as in claim 20, characterized in that the cover (68) is positioned in relation to the activating mechanism (54) such that a cover-locking mechanism (70) in the form of a catch becomes active or snaps in only when the activating mechanism (54) is in the tensioned state.

22. Mechanism as in claim 20, characterized by a safety switch that can be triggered to supply current to the electric motor by the cover (68) or by the cover-locking mechanism (70).

23. Mechanism as in claim 1, characterized in that at least one compression spring (60), preferably in the form of a helical spring or a set of cup springs, that acts against the force of the activating mechanism (54) is positioned in a space (62) between the spindle (18) and the tensioning anchor (22) and in that the force of the spring is more powerful than the resistance to displacement between the spindle (18) and the tensioning anchor (22), including the resistance to deformation and the resistance to flow on the part of the plastic material (40).

24. Mechanism as in claim 1, characterized in that toothed grooves are provided in the second space (44) and in the the piston (46) to prevent the piston from rotating.

25. Mechanism as in claim 1, characterized in that the plastic material is polyvinyl chloride (PVC) with a relatively low polymerization degree.

26. Mechanism as in claim 1, characterized in that the demarcating surface (36) arranged at the tensioning anchor (22) is related to the cross-sectional surface of the piston (46) by the ratio of at least 50:1.

27. Mechanism according to claim 26, characterized in that the demarcating surface (36) of the tensioning anchor (22) is related to the cross-sectional surface of the piston (46) by at least 100:1.

28. Mechanism according to claim 27, characterized in that the demarcating surface (36) of the tensioning anchor (22) is related to the cross-sectional surface of the piston (46) by at least 200:1.

* * * * *